US005383313A

United States Patent [19]

Deeke et al.

[11] Patent Number: 5,383,313

[45] Date of Patent: Jan. 24, 1995

[54] MINI STORAGE SILO

[76] Inventors: Ronald V. Deeke, 110 Glen Ellyn Rd. (I.N.); Gary A. Deeke, 110 Glen Ellyn Rd. (G.S.), both of Bloomingdale, Ill. 60108

[21] Appl. No.: 924,222

[22] Filed: Aug. 3, 1992

[51] Int. Cl.[6] ..... E06B 1/06

[52] U.S. Cl. ..... 52/82; 52/79.4; 52/192; 52/210; 49/366; 49/371

[58] Field of Search ..... 52/82, 36.4, 282.1, 52/282.4, 282.5, 245, 247, 197, 273, 79.4, 79.1, 264, 210, 27.5, 206, 192, 210; 49/366, 367, 371

[56] References Cited

U.S. PATENT DOCUMENTS

| | | | |
|---|---|---|---|
| 1,301,704 | 4/1919 | Joyce | 49/367 |
| 1,541,272 | 6/1925 | Neilson | 49/367 |
| 1,806,354 | 5/1931 | Lange | 52/82 |
| 1,912,502 | 5/1932 | Stotzer et al. | 52/82 X |
| 3,470,657 | 10/1969 | Irwin | 52/27 |
| 3,727,355 | 4/1973 | Vachon | 52/82 |
| 3,828,492 | 8/1974 | Schliemann et al. | 52/245 X |
| 3,851,427 | 12/1974 | Lacoste, III | 52/79.4 |
| 4,173,855 | 11/1979 | Raptoplous | 52/82 |
| 4,720,876 | 1/1988 | Tomei et al. | 49/371 X |
| 4,739,594 | 4/1988 | Langford et al. | 52/79.4 |
| 4,910,928 | 3/1990 | Cellar, Jr. | 52/82 |
| 5,029,420 | 7/1991 | Goto | 52/82 |
| 5,319,882 | 6/1994 | Biebuyck | 49/366 X |

*Primary Examiner*—Carl D. Friedman
*Assistant Examiner*—Robert J. Canfield
*Attorney, Agent, or Firm*—Charles F. Meroni, Jr.

[57] ABSTRACT

The mini storage silo comprises a tall, enclosed, octagonal structure which has a conical roof, two doors that swing away from one another to create a large opening into the interior thereof, an elevated floor, and a plurality of adjustable shelves therein. Optionally, the lower portion of the silo may serve as a dog house, with a canine entry being set into one of the walls just above the level of the floor.

23 Claims, 5 Drawing Sheets

MINI STORAGE SILO

BACKGROUND OF THE INVENTION

1. Field of the Invention

The present invention relates to a storage building for outdoor use which is in the form of a miniature silo. More particularly, the storage building is tall and narrow, having a plurality of eight sides and a conical roof. Doors provide access to the interior which includes shelves therein. As an option, a canine entry may be provided in one of the sides along a base of the building, creating a dog house within the structure as well.

2. Description of the Prior Art

Various storage structures for outdoor use have heretofore been proposed. For example, Design U.S. Pat. Nos. 223,814 and 211,239 disclose such structures.

Various portable storage structures are further proposed in U.S. Pat. Nos. 1,202,402; 1,307,333; 4,501,099; 4,481,774 and 4,573,293.

As will be described in greater detail hereinafter, the mini storage silo of the present invention differs from the previously proposed storage buildings by providing a tall, narrow structure which is suitable for use in confined or limited spaces and which has shelves therein upon which articles may be stored. Further, a dog house may be formed in a base portion thereof by the simple addition of a canine entry to one of the side walls of the structure.

SUMMARY OF THE INVENTION

According to the invention there is provided a mini storage silo structure for exterior use in confined spaces, the structure comprising a tall, octagonal in cross section structure having a frame and side wall panels mounted on six of eight sides thereof, the frame including six angularly related side wall panel frames, the frame further including a pair of angularly related door frame structures, the door frame structures being angularly mounted on the structure and leaving an open corner which enables an expanded door opening to be provided, swing apart doors hingedly mounted on the remaining two sides which doors when closed are disposed in an angled attitude toward one another to provide the structure with the octagonal cross section, a top octagonal frame section mounted horizontally on the frame, an octagonal base plate mounted to the top octagonal frame section, a conical roof assembly mounted to the top octagonal frame section and the base plate, an octagonal base upon which a floor is mounted, a plurality of elongated upright frame sections extending upwardly and mounted between the floor and the top octagonal frame section.

Further, according to the invention there is provided a number of semioctagonal shelves mounted in the structure above the octagonal base, and ledge elements engaged to the side wall panel frames thereof upon which the shelves rest.

DESCRIPTION OF THE PREFERRED EMBODIMENT

Figure 1:
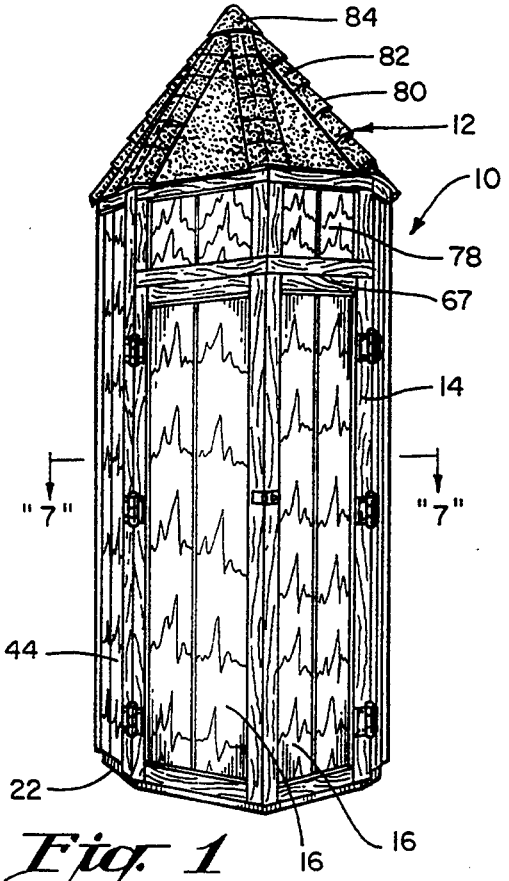
FIG. 1 is a perspective view of the mini storage silo of the present invention.
Figure 2:
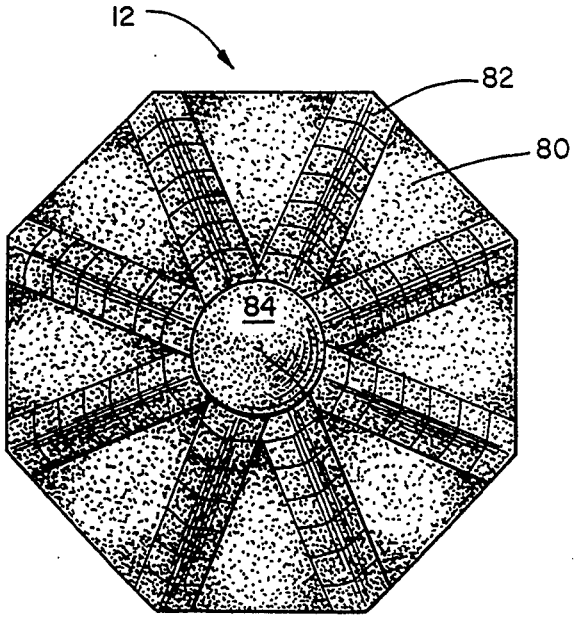
FIG. 2 is a top plan view of the roof of the silo of FIG. 1.
Figure 3:
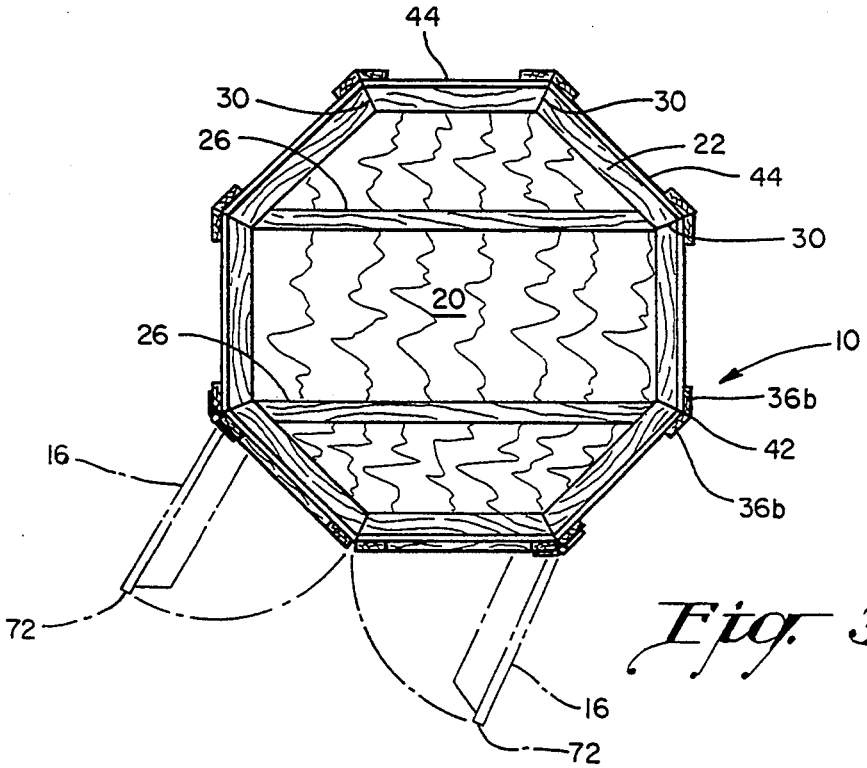
FIG. 3 is a bottom plan view of the silo of FIG. 1.
Figure 4:
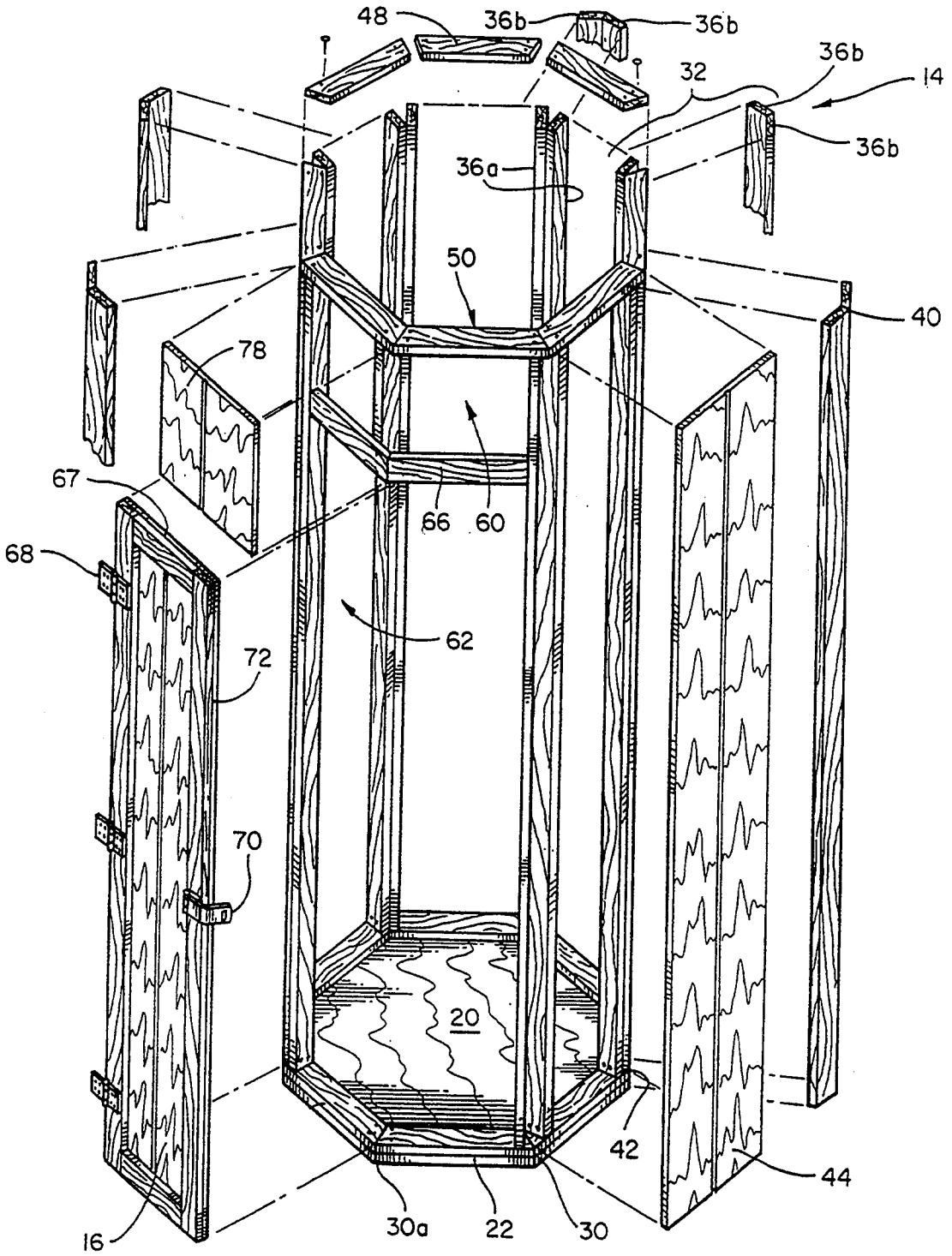
FIG. 4 is an exploded perspective view of the various structures forming the exterior of the silo.
Figure 5:
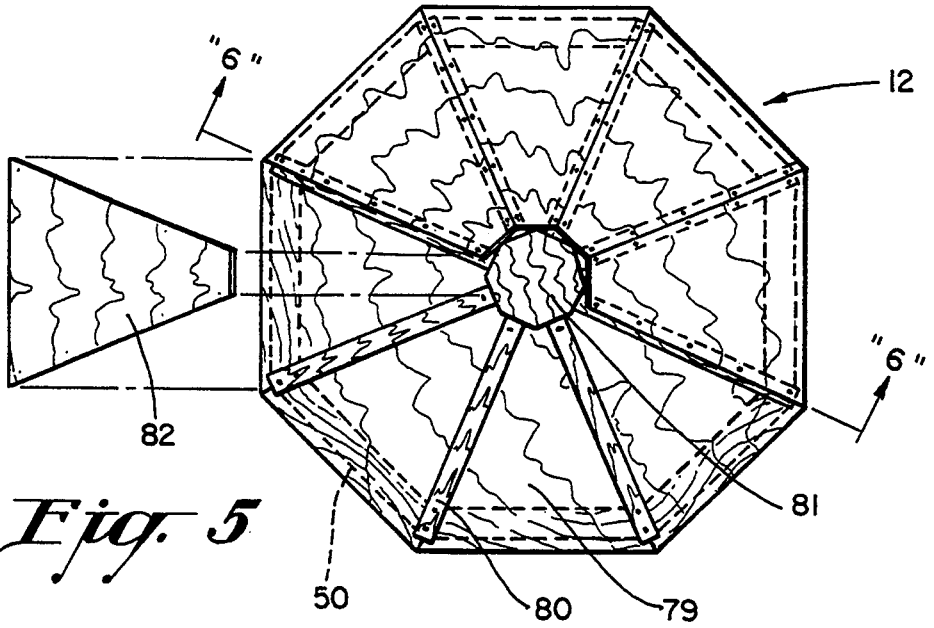
FIG. 5 is a top plan view with portions broken away and showing the construction of the roof of FIG. 2.
Figure 6:
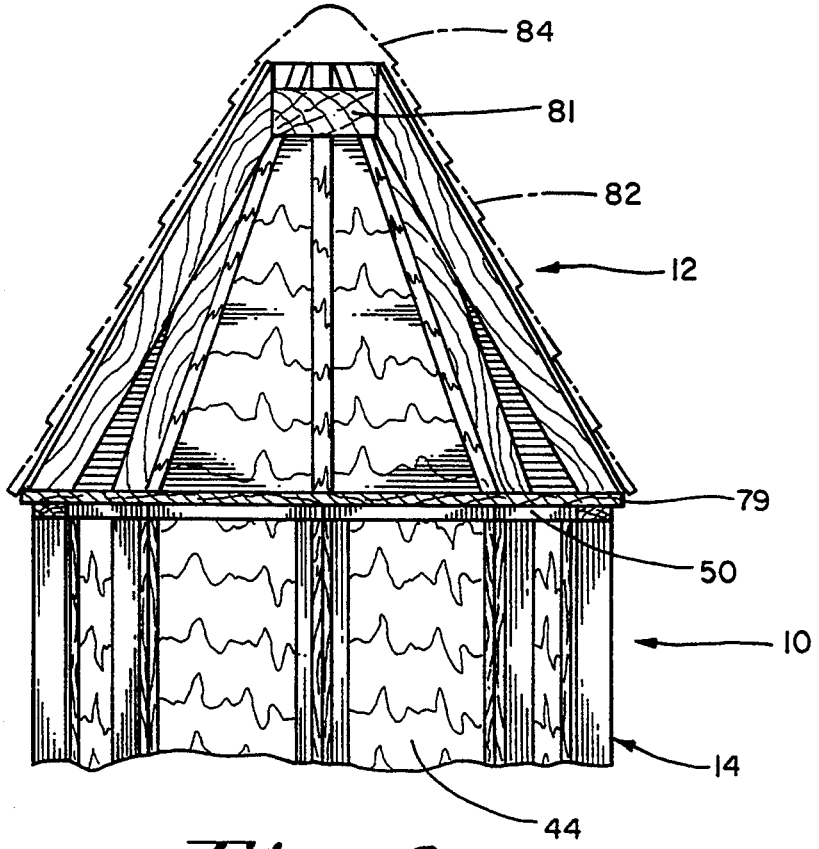
FIG. 6 is a side view of a top section of the silo showing further construction features of the roof.

Referring now to the drawings in greater detail, there is illustrated therein a mini storage silo 10 made in accordance with the teachings of the present invention.

The silo 10 includes a roof 12 and a body portion 14, the body portion 14 including two swing apart doors 16, allowing access to the interior of the silo 10.

The silo 10 further has a wood floor 20, with a base 22 thereof elevating the floor 20 above ground level. To maintain the floor 20 level, a plurality of cross supports 26 are provided thereunder.

It will be seen that the silo 10 is octagonal in cross section, creating eight corners 30 about the floor 20.

Seven of the corners 30 each have an upright support assembly 32 mounted thereto and extending upwardly therefrom, each such support assembly 32 being engaged through the floor 20 and to the base 22, for stability. No such support assembly is present at one corner **30*a***.

Each support assembly 32 comprises four elongate elements, two of which form a side wall panel frame, **36*a*, straddle the base 22 in a manner to form a V with an open end thereof facing radially outwardly and two others of which, 36*b* form an elongated upright frame section and, are engaged side by side to an outer radial surface of the members 36*a* in a manner where the point of juncture 40 between the elements 36*b* overlies a point 42 at each corner 30, the elements 36*b* thus straddling the point 42 and securing joints formed between contiguous wall panels 44 engaged between and to the elements 36*a* and 36*b***.

This configuration of the elements **36*a* and 36*b* provides an extremely stable support for outside panels 44 forming the walls 44 of the silo 10**.

Of course, it will be understood that adjacent elements **36*a* are engaged together along their top surfaces 46 by planar members 48, creating a peripheral top enclosure base 50**, which is also octagonal.

As disclosed earlier, swing apart doors 16 are provided to allow access to an interior 60 of the silo 10.

To provide an uninterrupted width to a door opening 62 spanning two sides of the silo 10, no support assembly 32 is provided at the corner **30*a*, at which the doors 16 engage one another. Rather, to maintain stability across the door opening 62, a support 66, two angularly related door frame structures, is provided. This support 66 is placed at a vertical position such that a top edge 67 of the doors 16 seats therebeneath when the doors 16** are closed.

Each door 16 is engaged to a support assembly 32 framing the opening 62. The engagement is created using hinges 68 in known manner, with a hasp type lock 70 engaging swing edges 72 of the doors 16 together when closed.

As described above, the remainder of the exterior of the silo 10 is formed of wood panel sections 44 which are nailed or otherwise fixed to and within the support assemblies 32, with smaller sections 78 being engaged above the doors 16, to create an enclosed structure, inasmuch as the doors 16 terminate below the level of the roof 12.

Next, the roof 12 is created in tepee fashion. An octagonal base plate 79 is fixed to the top support 50, with struts 80 extending upwardly from this base plate 79 and radially inwardly to form an octagonal cone against a top plug 81 member engaged between upper ends of the struts 80. Wood panels 82 covered with asphalt roofing material are engaged to and between adjacent struts 80, with joints therebetween being covered with shingles 82 in known manner. A shingled cone shaped cap 84 is fixed over the plug 81 to complete the exterior of the silo 10.

It will be understood that all frame members, support members, and struts of the silo 10 are made from two by fours for a sturdy, fairly immobile construction. Further, if desired, the base 22 of the silo 10 can be fixed to the ground therebeneath.

Also, it has been found through empirical testing that the octagonal shape proposed is the most aesthetically pleasing as well as the most economical configuration as related to material requirements.

Figure 7:
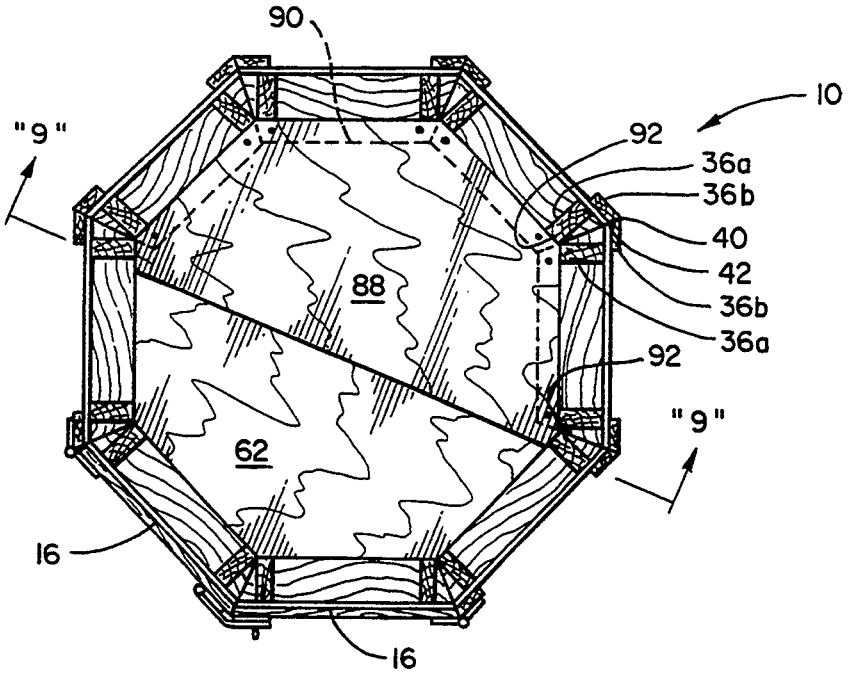
FIG. 7 shows one of the shelves within the silo and is taken along line 7—7 of FIG. 1.
Figure 9:
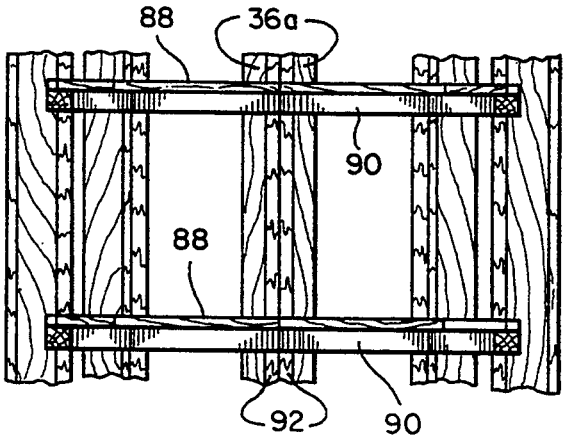
FIG. 9 shows two shelf mounting ledges having shelves thereon of the silo and is taken along line 9—9 of FIG. 7.

Turning next to the interior 60 of the silo 10, it will be seen that shelves 88 are provided therein, upon which items may be stored. These shelves 88 are seen to be configured in a semihexagon, and are located in one half of the silo 10 which is directly opposite the doors 16. These shelves 88 may be supported at any desired height by the provision of edge flanges 90 which are engaged to an inner end edge surface 92 of each of the members **36*a* as best shown in FIGS. 7 and 9**.

Figure 8:
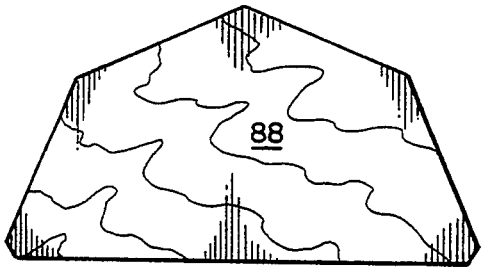
FIG. 8 is a plan view of one shelf.

Each shelf 88 has chamfered corners 94 to accommodate the elements of the support assemblies 32 extending around the periphery thereof, as shown in FIG. 8.

Figure 10:
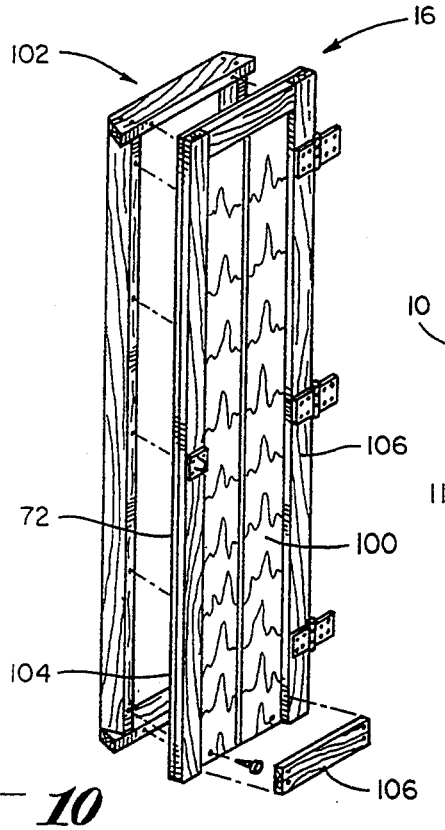
FIG. 10 is an exploded perspective view of one of the silo doors.

In FIG. 10, it will be seen that each door 16 is reinforced. In this respect, each door comprises a door panel 100 which is secured to a frame 102 attached to an inner surface thereof. Further, front surface edges 104 of the door panel 100 are framed with edging members 106 which are engaged through the panel 100 to the frame 102, such engagement being created in any suitable manner.

Figure 11:
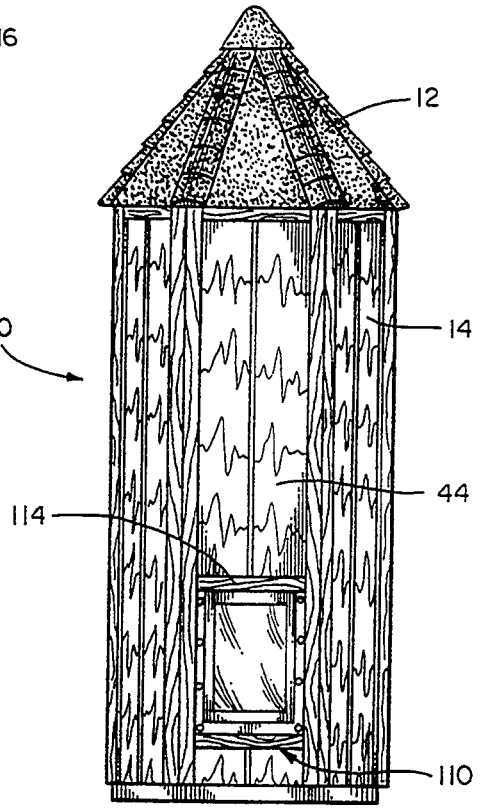
FIG. 11 shows a canine entry incorporated into one of the side walls of the silo.
Figure 12:
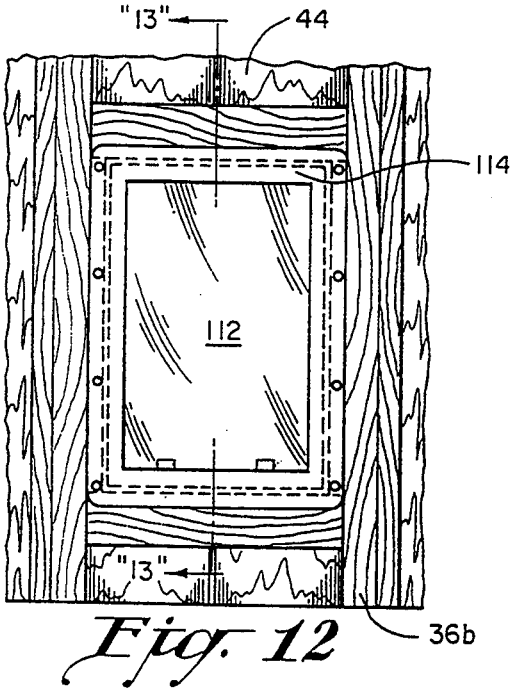
FIG. 12 is an enlarged view of the canine entry.
Figure 13:
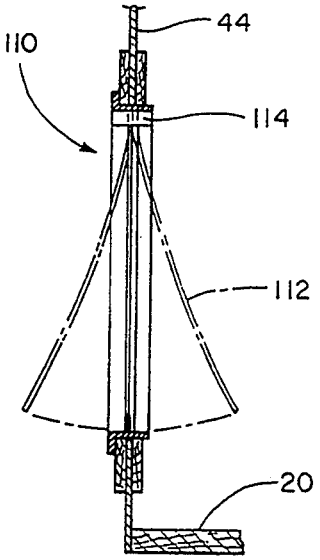
FIG. 13 is a side view of the canine entry.

In FIGS. 11–13, the optional canine entry 110 is shown in detail. It will be understood that such entry 110 should be placed just above "floor" level, and should be incorporated into a wall forming panel 44, preferably one which is opposite the doors 16. Such entry 110 typically comprises a flap member 112 hingedly secured to a frame 114 therefor, the frame 114 being engageable to the surrounding wall panel 44. Such canine entry 110 may be of the type made by Johnson Pet Door, Inc. of Valencia, Calif.

It will be obvious that a lowermost shelf 88 will be placed at a level which will not interfere with use of the base area of the silo 10 as a doghouse.

As described above, the silo 10 of the present invention has a number of advantages, some of which have been described above and others of which are inherent in the invention. Further, modifications can be proposed to the silo 10 without departing from the teachings herein. Accordingly the scope of the invention is only to be limited as necessitated by the accompanying claims.

I claim:

1. A mini storage silo structure for exterior use in confined spaces, said structure comprising a tall, octagonal in cross section structure having a frame and side wall panels mounted on six consecutive sides of eight sides thereof, the frame including six angularly related side wall panel frames, the frame further including a pair of angularly related door frame structures, the door frame structures being angularly mounted on the structure and leaving an open corner which enables an expanded door opening to be provided, swing apart doors hingedly mounted on the remaining two sides which doors when closed are disposed in an angled attitude toward one another to provide the structure with the octagonal cross section, a top octagonal frame section mounted horizontally on the frame, an octagonal base plate mounted to the top octagonal frame section, a conical roof assembly mounted to said top octagonal frame section and said base plate, an octagonal base upon which a floor is mounted, a plurality of elongated upright frame sections extending upwardly and mounted between said floor and said top octagonal frame section, and further having a plurality of semioctagonal shelves mounted therein.

2. The structure of claim 1 further including ledge elements engaged to the side wall panel frames thereof upon which said shelves rest.

3. The structure of claim 2 wherein said shelves have chamfered corners.

4. The structure of claim 3 wherein said doors are reinforced and include a frame therearound.

5. The structure of claim 4 wherein said conical roof assembly comprises eight struts, lower ends of the struts are fixed radially on the edges of the base plate and extend upwardly from the base plate and radially inwardly to form an octagonal cone frame, a top plug member is attached to upper ends of the struts, and roof panels being attached to and between adjacent struts forming an octagonal cone roof.

6. The structure of claim 5 wherein said roof panels are covered with asphalt.

7. The structure of claim 6 wherein a conical asphalt cap is engaged over the top plug member.

8. The structure of claim 7 wherein the frame and struts comprise two by four wood members.

9. The structure of claim 8 wherein all panels comprise weather-proofed wood panels.

10. The structure of claim 9 wherein said door frame structures include two short panel sections which are engaged above the level of the doors and extend to a lower edge of the roof.

11. The structure of claim 10 wherein ends of said two by fours used in framing the roof are mitred at their ends.

12. The structure of claim 11 wherein said roof panels are triangular.

13. The structure of claim 12 wherein an opening covered by said doors is uninterrupted.

14. The structure of claim 1 further including a pet entry built into one of the side wall panels thereof at a level just above the floor of the structure.

15. A mini storage silo structure for exterior use in confined spaces, said structure comprising a tall, octagonal in cross section structure having a frame and side wall panels mounted on six consecutive sides of eight sides thereof, the frame including six angularly related side wall panel frames, the frame further including a pair of angularly related door frame structures, the door frame structures being angularly mounted on the structure and leaving an open corner which enables an expanded door opening to be provided, swing apart doors hingedly mounted on the remaining two sides which doors when closed are disposed in an angled attitude toward one another to provide the structure with the octagonal cross section, a top octagonal frame section mounted horizontally on the frame, an octagonal base plate mounted to the top octagonal frame section, a conical roof assembly mounted to said top octagonal frame section and said base plate, an octagonal base upon which a floor is mounted, a plurality of elongated upright frame sections extending upwardly and mounted between said floor and said top octagonal frame section.

16. The structure of claim 15 wherein said doors are reinforced and include a frame therearound.

17. The structure of claim 16 wherein said conical roof assembly comprises eight struts, lower ends of the struts are fixed radially on the edges of the base plate and extend upwardly from the base plate and radially inwardly to form an octagonal cone frame, a top plug member is attached to upper ends of the struts, and roof panels being attached to and between adjacent struts forming an octagonal cone roof.

18. The structure of claim 17 wherein said roof panels are covered with asphalt.

19. The structure of claim 18 wherein an asphalt cap is engaged over the top plug member.

20. The structure of claim 15 further including a plurality of semioctagonal shelves mounted in said structure above said octagonal base, and ledge elements engaged to the side wall panel frames thereof upon which said shelves rest.

21. The structure of claim 20 wherein said shelves have chamfered corners.

22. The structure of claim 15 wherein said door frame structures include two short panel sections which are engaged above the level of the doors and extend to a lower edge of the roof.

23. The structure of claim 15 further including a pet entry built into one of the side wall panels thereof at a level just above the floor of the structure.

* * * * *